US008233010B2

(12) United States Patent
Ma

(10) Patent No.: US 8,233,010 B2
(45) Date of Patent: Jul. 31, 2012

(54) DISPLAY INTERFACE AND DISPLAY METHOD FOR ON SCREEN DISPLAY

(75) Inventor: Hung-Min Ma, Hsinchu (TW)

(73) Assignee: Mitac Technology Corp., Hsinchu (TW)

( * ) Notice: Subject to any disclaimer, the term of this patent is extended or adjusted under 35 U.S.C. 154(b) by 623 days.

(21) Appl. No.: 12/275,921

(22) Filed: Nov. 21, 2008

(65) Prior Publication Data

US 2010/0128056 A1 May 27, 2010

(51) Int. Cl.
*G09G 5/00* (2006.01)
*G09G 5/02* (2006.01)

(52) U.S. Cl. ..... 345/629; 345/592

(58) Field of Classification Search ..... 345/629, 345/440, 176
See application file for complete search history.

(56) References Cited

U.S. PATENT DOCUMENTS 5,264,838 A * 11/1993 Johnson et al. ..... 345/611
2002/0030702 A1* 3/2002 Gould et al. ..... 345/850
2006/0268121 A1* 11/2006 Watanabe ..... 348/231.2
2007/0080905 A1* 4/2007 Takahara ..... 345/76
2008/0098323 A1* 4/2008 Vallone et al. ..... 715/772
2010/0094096 A1* 4/2010 Petruzzelli et al. ..... 600/300
2010/0274372 A1* 10/2010 Nielsen et al. ..... 700/94

FOREIGN PATENT DOCUMENTS

CN 1812425 A 8/2006

OTHER PUBLICATIONS

Chinese Office Action, citing out CN 1812425A.
English translation of abstract from CN 1812425A.

* cited by examiner

*Primary Examiner* — Kee M Tung
*Assistant Examiner* — Leon T Cain, II
(74) *Attorney, Agent, or Firm* — Apex Juris, pllc; Tracy M. Heims

(57) ABSTRACT

A display interface for on screen display is disclosed. The display interface comprises a pattern and a layer with black and transparent background. When an on screen display (OSD) is activated, the pattern corresponding to the OSD is displayed, the black and transparent background is rendered, and radiative transition effect is implemented to the pattern.

18 Claims, 7 Drawing Sheets

DISPLAY INTERFACE AND DISPLAY METHOD FOR ON SCREEN DISPLAY

BACKGROUND OF THE INVENTION

1. Field of the Invention

The invention relates to on screen display (OSD), and more particularly to a display interface and display method for OSD.

2. Description of the Related Art

Display of on screen display (OSD) of current computer devices (for example, notebook (NB) or liquid crystal display (LCD)) is two-dimensionally represented with respect to adjustment of brightness or volume or switch of hardware functions such as wireless LAN and sunlight readable, as shown in FIGS. 1A~1C.

Generally, when a display interface of the OSD is activated, icons and wording are simultaneously displayed, even displaying the wording or a bar merely, as shown in FIGS. 1A~1C. With respect to development of computer devices, the display interface of the OSD cannot satisfy user requirements, so a 2.5 dimensional/3 dimensional (2.5D/3D) display interface of the OSD is designed to enhance added value and refinement.

However, the 2.5D/3D pattern design only considers display effect with a colorful background that other effects may not be observed under a white background, resulting in inconvenience of reading.

Thus, a display interface and display method for OSD is desirable.

BRIEF SUMMARY OF THE INVENTION

Display methods for on screen display are provided. An exemplary embodiment of a display method for on screen display comprises the following. Radiative transition effect is provided for a display interface capable of an on screen display (OSD), wherein the radiative transition effect comprises scroll-in effect and scroll-out effect. It is determined whether the OSD is activated. A full-color pattern corresponding to the OSD is displayed when the OSD is activated. A layer with a black and transparent background is rendered and the scroll-in effect is displayed. It is determined whether the OSD is switched to off. It is determined whether display of the full-color pattern reaches a predetermined time if the OSD is not switched to off. The layer with the black and transparent background is rendered and the scroll-out effect is displayed if the OSD is switched to off.

Display interfaces are provided. An exemplary embodiment of a display interface comprises a pattern and a layer with a black and transparent background. When the OSD is activated, the pattern corresponding to the OSD is displayed, a layer with a black and transparent background is rendered, and radiative transition effect is implemented on the pattern.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
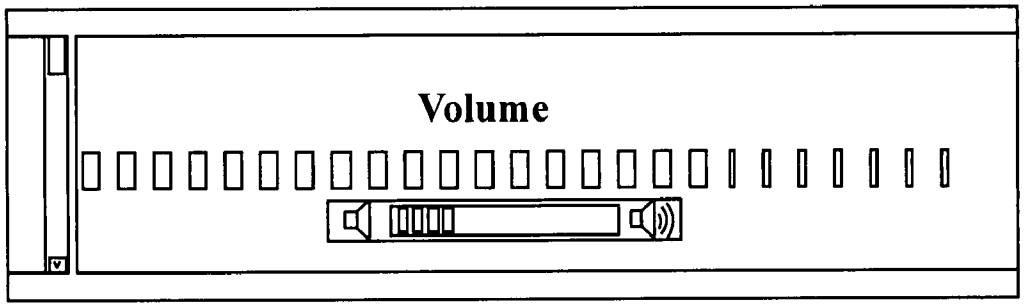
FIGS. 1A~1C are schematic views of a conventional display interface for OSD which is two-dimensionally represented.
Figure 1B:
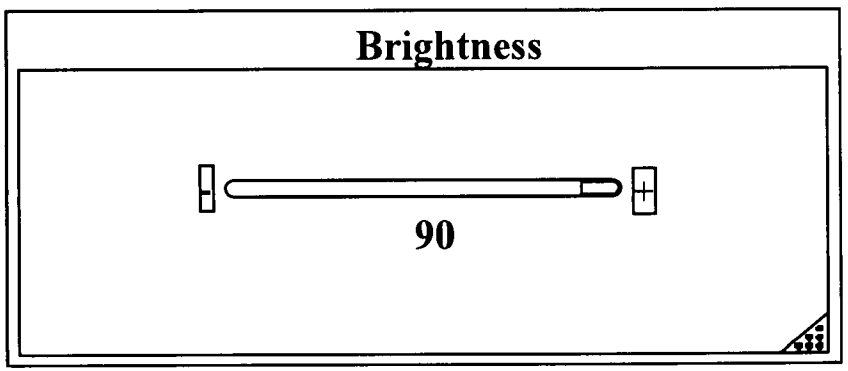
Figure 1C:
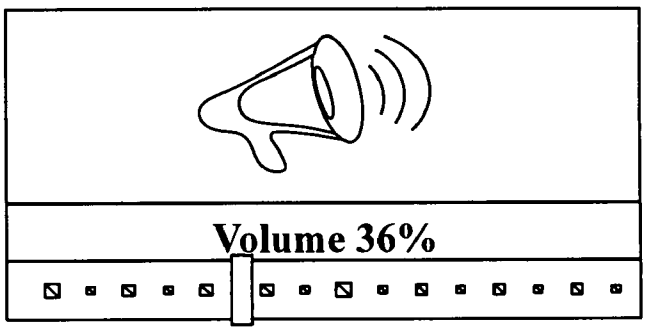

Several exemplary embodiments of the invention are described with reference to FIGS. 2A through 4, which generally relate to a display interface and display method for OSD. It is to be understood that the following disclosure provides various different embodiments as examples for implementing different features of the invention. Specific examples of components and arrangements are described in the following to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various described embodiments and/or configurations.

The invention discloses a display interface and display method for OSD.

Figure 2A:
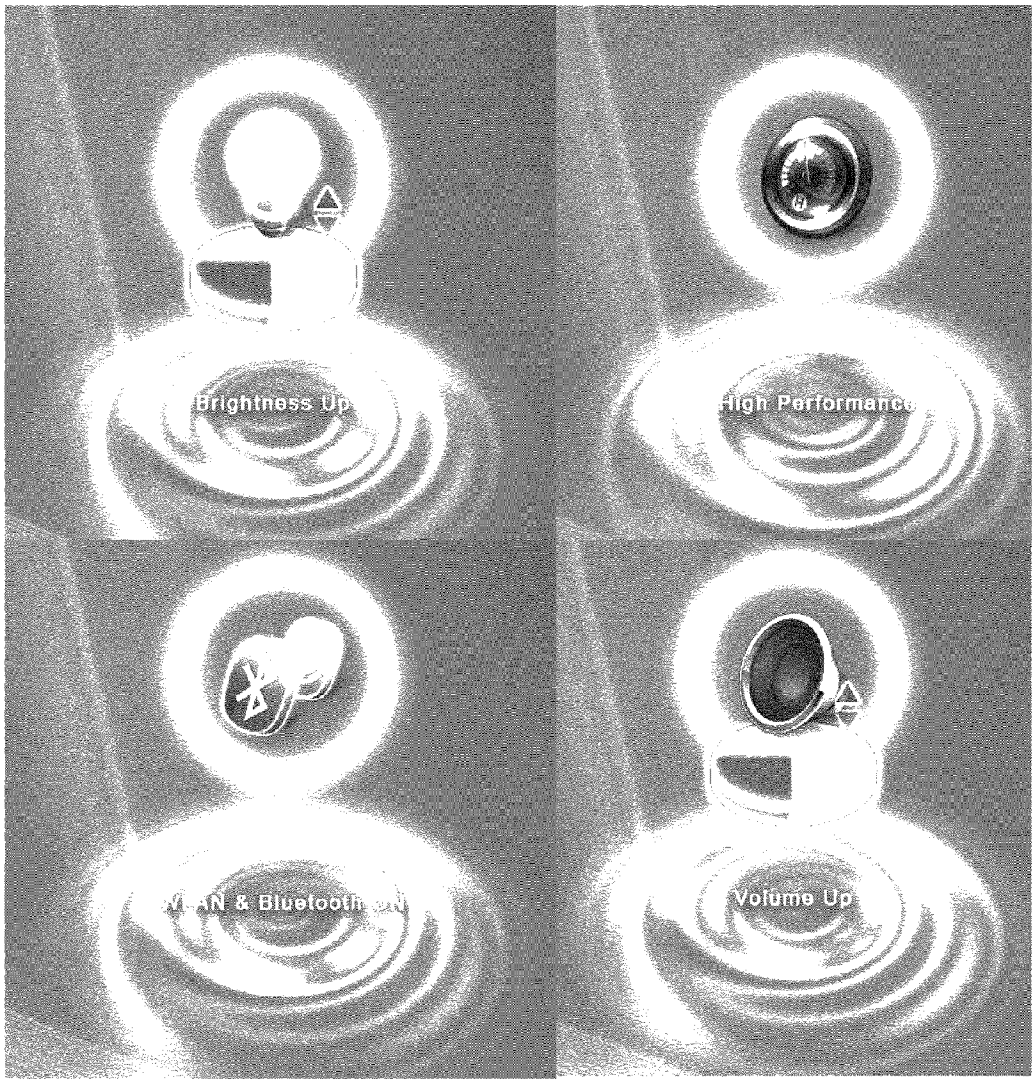
FIGS. 2A~2B and 3A~3C are schematic views of a display interface for OSD of the present invention.
Figure 2B:
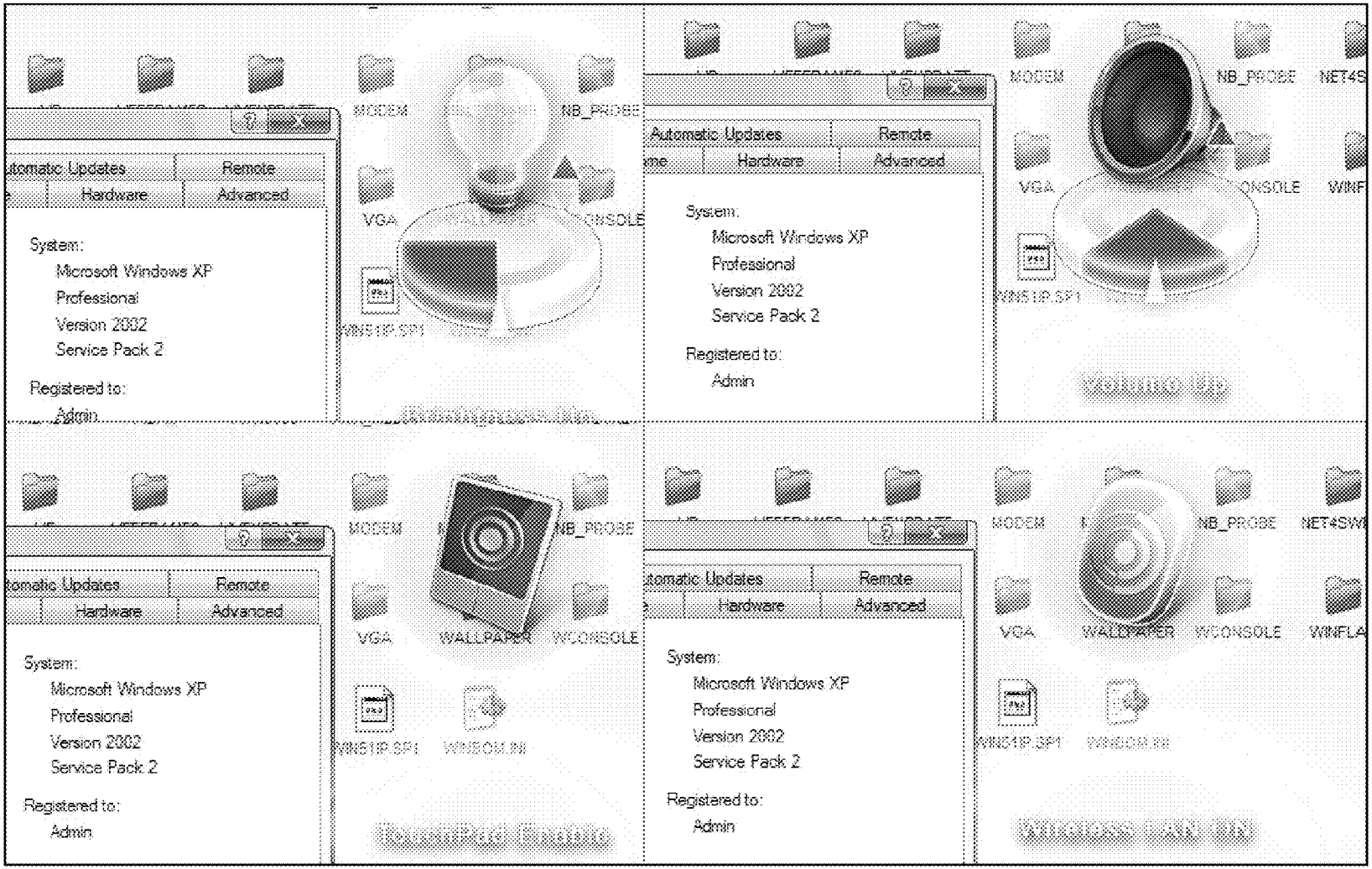
Figure 3A:
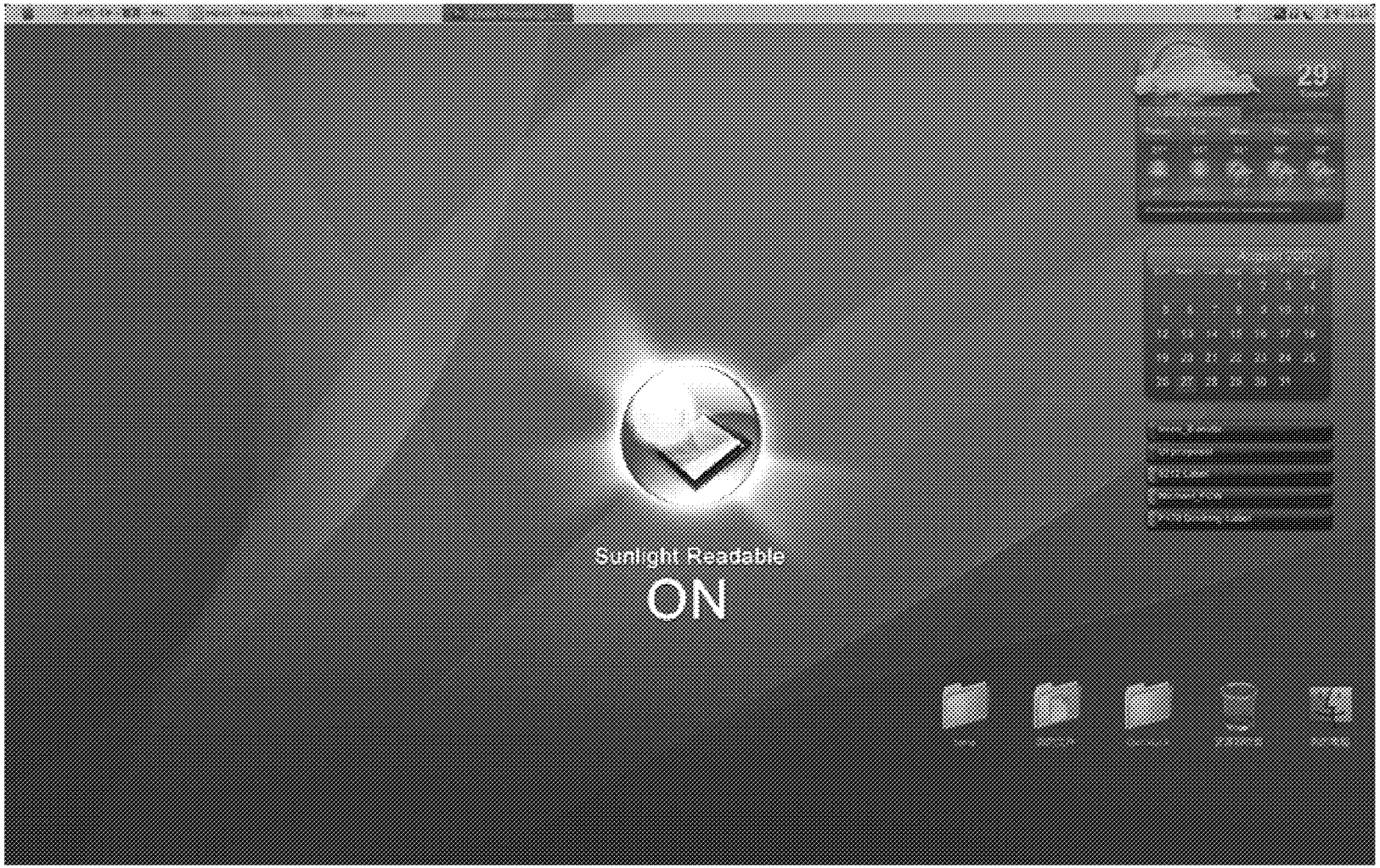
Figure 3B:
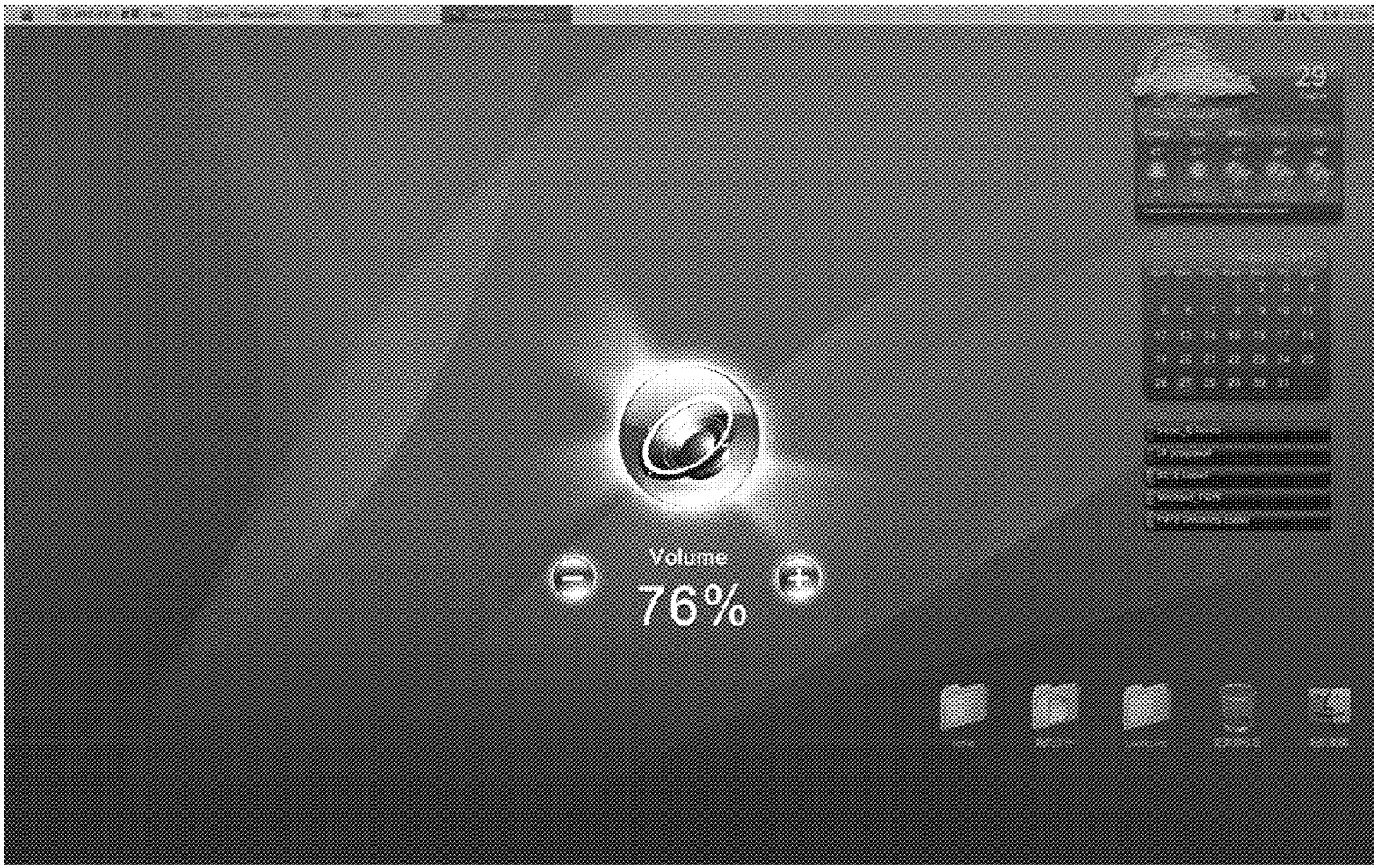

An embodiment of a display interface for OSD introduces more beautiful 2.5D/3D icons to enhance brand value and quality of the display interface for OSD (as shown in FIGS. 2A and 2B) that applies radiative transition effect (halation scroll-in, for example) to enhance representative effect of the display interface for OSD (as shown in FIGS. 3A and 3B). Thus, added value and refinement of a computer product can be enhanced to solve the problem that the display interface for OSD is interfered when different desktops are represented.

Figure 3C:
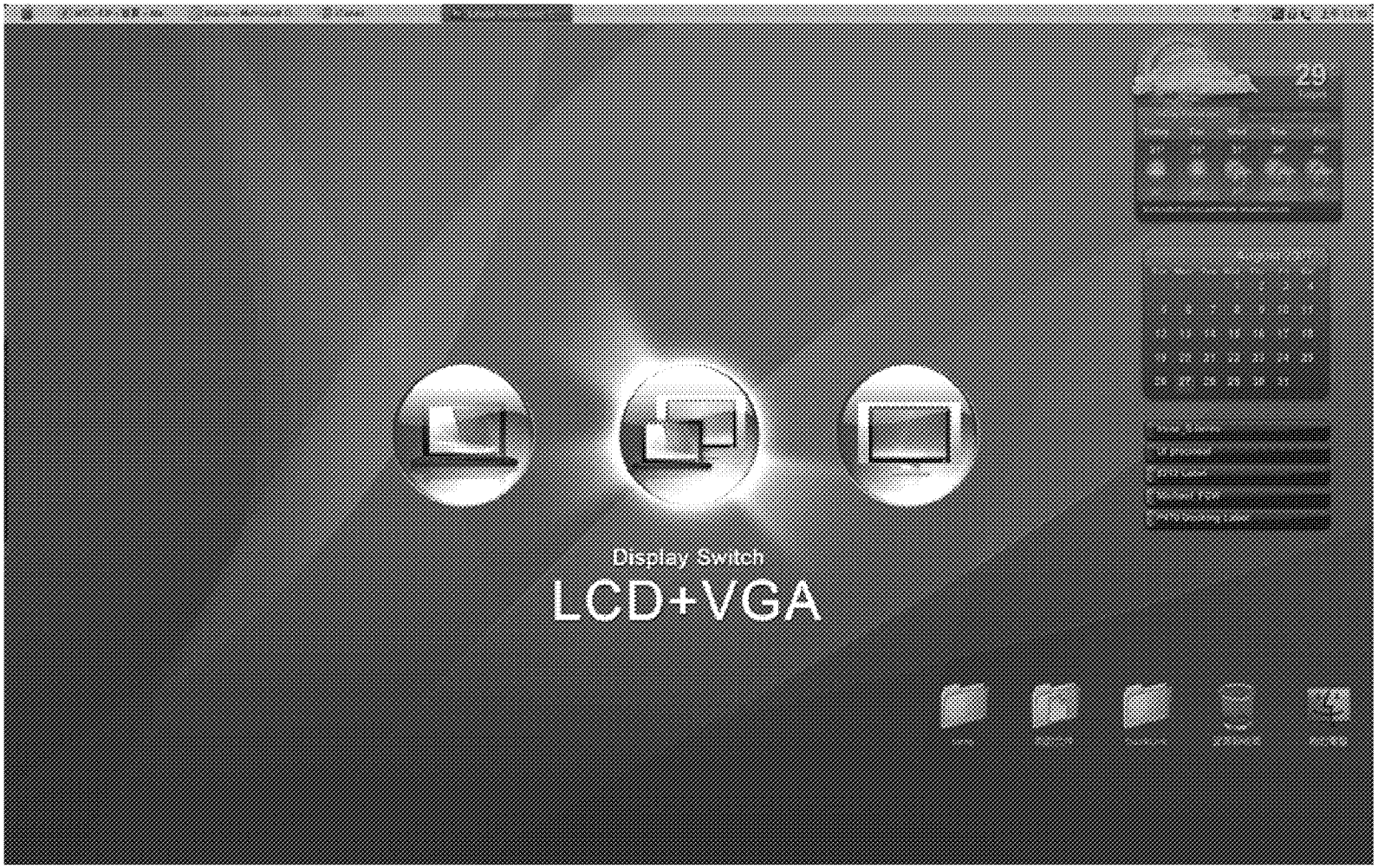

An embodiment of the invention first applies the radiative transition effect to different functions of the OSD, comprising switch of networks (such as WiMAX, Bluetooth, or infrared rays), use of touchpad, adjustment of brightness, and so on, and further comprising enabled/disabled (ON/OFF) of a sunlight readable mode (as shown in FIG. 3A), a volume plus/minus mode (as shown in FIG. 3B), and a display switch mode (as shown in FIG. 3C).

When the sunlight readable mode is enabled (ON), a full-color sunlight readable pattern is displayed with applied for the radiative transition effect while the full-color sunlight readable pattern is converted a gray-level pattern when the sunlight readable mode is disabled (OFF). When the volume is increased or decreased, a full-color volume pattern is displayed with applied for the radiative transition effect. When the display mode is switched, a full-color display pattern is displayed with applied for the radiative transition effect.

It is noted the radiative transition effect comprises scroll-in effect and scroll-out effect. The scroll-in effect represents radiative rays with a clockwise or anticlockwise direction while the scroll-out effect represents radiative rays with a direction opposite to that for the scroll-in effect. Additionally, partial functions of the OSD provide an enabled/disabled (ON/$OFF) modes, such as the sunlight readable mode, the display switch (comprising LCD, LCD+VGA, and VGA), the network switch (comprising WiMAX, Bluetooth, or infrared rays), the use of the touchpad, and so on. Partial functions of the OSD only provide an enabled (ON) mode, such as adjustment of the volume and brightness, and so on.

Display rules for the display interface for the OSD are described in the following.

When one of the OSD mode is enabled, a full-color pattern corresponding to the OSD mode is displayed while the pattern is converted to a gray-level pattern if the OSD mode is disabled. Regardless of the OSD mode is enabled or disabled, the displayed pattern is faded when display time thereof reaches a predetermined time (3 seconds, for example).

When the scroll-in effect of the radiative transition effect is generated, a pattern corresponding to an OSD mode is assigned halation scroll-in effect regardless of the OSD mode is enabled or disabled. As shown in FIGS. 3A and 3B, for example, when sunlight readable mode or the volume plus/minus mode is enabled, a pattern corresponding thereto is displayed and the halation scroll-in effect is assigned thereto.

When the scroll-out effect of the radiative transition effect is generated, a pattern switched to on is assigned the scroll-out effect while a pattern switched to off is not assigned the scroll-out effect but is only assigned gray out effect. As shown in FIG. 3, for example, when the display is switched from the "LCD" mode to the "LCD+VGA" mode, a pattern for the "LCD+VGA" mode is assigned the halation scroll-in effect while a pattern for the "LCD" mode is assigned gray out effect.

Since the halation is displayed as the while color, a layer with a black and 50% transparent background is rendered before the radiative transition effect is generated to enhance the radiative effect, such that the radiative transition effect can be seen even if the background of the desktop of a computer device is represented as white color.

Figure 4:
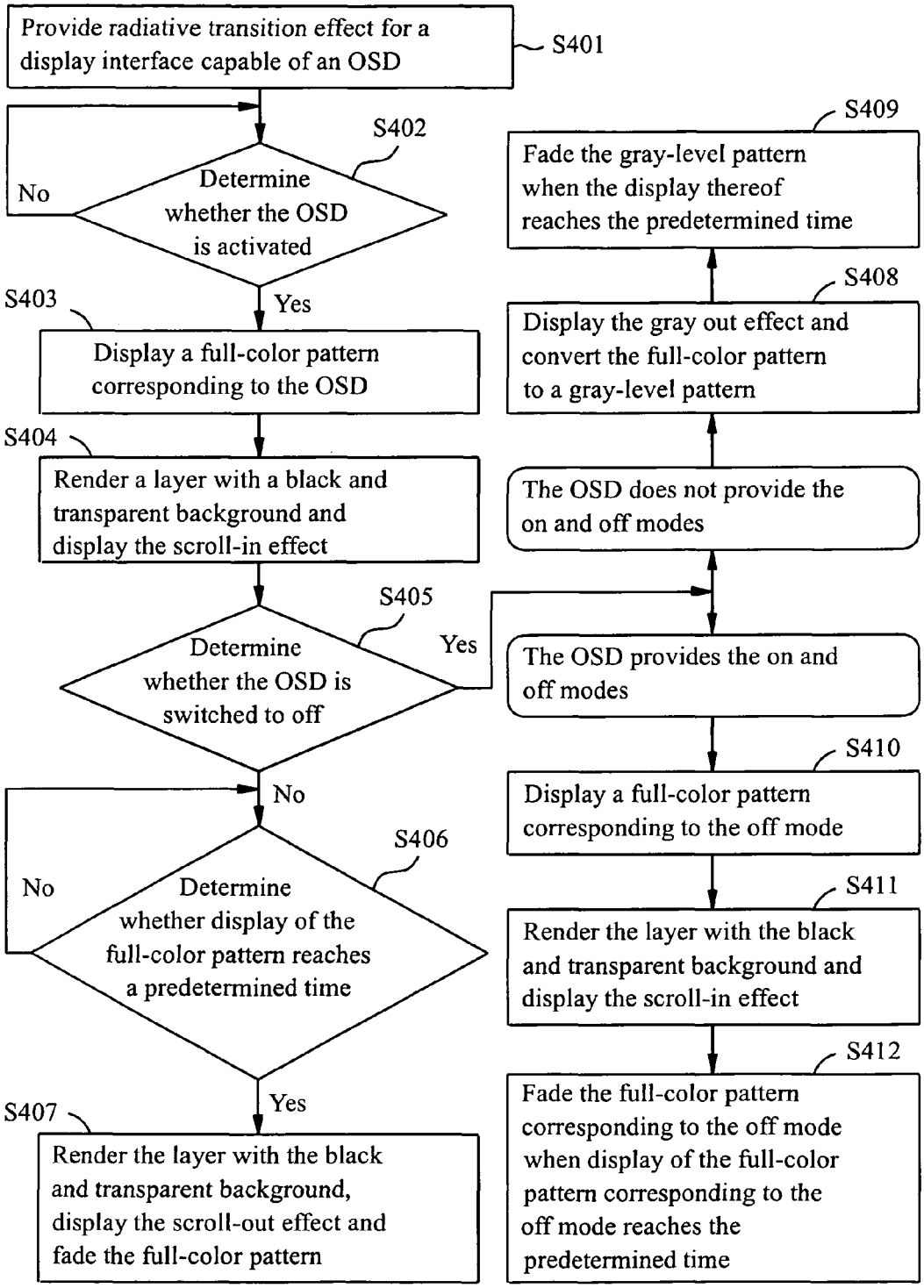
FIG. 4 is a flowchart of a display method for OS of the present invention.

FIG. 4 is a flowchart of a display method for OS of the present invention.

Radiative transition effect is provided for a display interface capable of an on screen display (OSD) (step S401), wherein the radiative transition effect comprises scroll-in effect and scroll-out effect. It is determined whether the OSD is activated (step S402). A full-color pattern corresponding to the OSD is displayed when the OSD is activated (step S403) and a layer with a black and 50% transparent background is rendered and the scroll-in effect (the halation scroll-in effect) is displayed (step S404).

It is determined whether the OSD is switched to off (step S405). It is determined whether display of the full-color pattern reaches a predetermined time if the OSD is not switched to off (step S406). The layer with the black and transparent background is rendered and 50% transparent background and the scroll-out effect (the halation scroll-out effect) is displayed, if the display of the full-color pattern reaches the predetermined time, and the full-color pattern is faded (step S407).

If the OSD is switched to off, the gray out effect is displayed and the full-color pattern is converted to a gray-level pattern when the OSD does not provide the on and off modes (step S408), and the scroll-out effect (the halation scroll-out effect) is not displayed and the gray-level pattern is faded when the display thereof reaches the predetermined time (step S409).

If the OSD is switched to off, a full-color pattern corresponding to the off mode is displayed when the OSD provides the on and off modes (step S410), the layer with the black and 50% transparent background is rendered and the scroll-in effect is displayed (step S411), and the full-color pattern corresponding to the off mode is faded when display of the full-color pattern corresponding to the off mode reaches the predetermined time (step S412)

Methods and systems of the present disclosure, or certain aspects or portions of embodiments thereof, may take the form of a program code (i.e., instructions) embodied in media, such as floppy diskettes, CD-ROMS, hard drives, firmware, or any other machine-readable storage medium, wherein, when the program code is loaded into and executed by a machine, such as a computer, the machine becomes an apparatus for practicing embodiments of the disclosure. The methods and apparatus of the present disclosure may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for practicing and embodiment of the disclosure. When implemented on a general-purpose processor, the program code combines with the processor to provide a unique apparatus that operates analogously to specific logic circuits.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display method for on screen display, comprising:

providing radiative transition effect for a display interface capable of an on screen display (OSD), wherein the radiative transition effect comprises scroll-in effect and scroll-out effect;

determining whether the OSD is activated;

displaying a full-color pattern corresponding to the OSD when the OSD is activated;

rendering a black background layer and displaying the scroll-in effect;

determining whether the OSD is switched to off;

determining whether display of the full-color pattern reaches a predetermined time if the OSD is not switched to off;

rendering the black background layer and displaying the scroll-out effect and fading the full-color pattern if the display of the full-color pattern reaches the predetermined time; and displaying 2.5D/3D icons on the on screen display, wherein the 2.5D/3D icons enter or exit the display via the scroll-in or scroll-out effect and wherein the transparency percentage of the black background layer is uniform over the entire black background layer.

2. The display method for on screen display as claimed in claim 1, further comprising:

if the OSD is switched to off, displaying gray out effect and converting the full-color pattern to a gray-level pattern when the OSD does not provide on and off modes; and fading the gray-level pattern when display of the gray-level pattern.

3. The display method for on screen display as claimed in claim 2, further comprising:

if the OSD is switched to off, displaying a full-color pattern corresponding to the off mode when the OSD provides the on and off modes;

rendering the black background layer and displaying the scroll-in effect; and fading the full-color pattern corresponding to the off mode when display of the full-color pattern corresponding to the off mode reaches the predetermined time.

4. The display method for on screen display as claimed in claim 1, wherein transparency of the black background layer is 50%.

5. A display interface apparatus, comprising:

A processor rendering a pattern; and

A black background layer, wherein when an OSD is activated, the pattern corresponding to the OSD is displayed, a black background layer is rendered, and a radiative transition effect is implemented on the pattern and wherein 2.5/3D icons are displayed on a computer device via the display interface and wherein the transparency percentage of the black background layer is uniform over the entire black background layer.

6. The display interface apparatus as claimed in claim 5, wherein the pattern is a full-color pattern when the OSD is activated.

7. The display interface apparatus as claimed in claim 6, wherein the full-color pattern is converted to a gray-level pattern when the OSD is disabled.

8. The display interface apparatus as claimed in claim 7, wherein, regardless of activating or disabling the OSD, the pattern is faded when display of the pattern reaches a predetermined time.

9. The display interface apparatus as claimed in claim 5, wherein the radiative transition effect comprises scroll-in effect and scroll-out effect, and, when the scroll-in effect is generated, the radiative transition effect is implemented on the pattern regardless of activating or disabling the OSD.

10. The display interface apparatus as claimed in claim 9, wherein halation scroll-out effect is implemented on the pattern switched to on when the scroll-out effect is generated.

11. The display interface apparatus as claimed in claim 9, wherein gray out effect is implemented on the pattern switched to off.

12. The display interface apparatus as claimed in claim 5, wherein transparency of the layer with the black and transparent background is 50%.

13. A non-transitory computer-readable medium encoded with computer executable instructions for performing a display method for on screen display, the computer executable instructions comprising:

providing radiative transition effect for a display interface capable of an on screen display (OSD), wherein the radiative transition effect comprises scroll-in effect and scroll-out effect for entering and exiting the OSD;

determining whether the OSD is activated;

displaying a full-color pattern corresponding to the OSD when the OSD is activated;

rendering a black background layer and displaying the scroll-in effect;

determining whether the OSD is switched to off;

determining whether display of the full-color pattern reaches a predetermined time if the OSD is not switched to off; and rendering the black background layer and displaying the scroll-out effect if the OSD is switched to off, wherein 2.5D/3D icons are displayed on an on screen display via the display method and wherein the transparency percentage of the black background layer is uniform over the entire black background layer.

14. The computer-readable medium as claimed in claim 13, further comprising:

if the OSD is switched to off, displaying gray-level out effect and converting the full-color pattern to a gray-level pattern when the OSD does not provide on and off modes; and fading the gray-level pattern when display of the gray-level pattern.

15. The computer-readable medium as claimed in claim 14, further comprising:

if the OSD is switched to off, displaying a full-color pattern corresponding to the off mode when the OSD provides the on and off modes;

rendering the black background layer and displaying the scroll-in effect; and fading the full-color pattern corresponding to the off mode when display of the full-color pattern corresponding to the off mode reaches the predetermined time.

16. The computer-readable medium as claimed in claim 13, wherein transparency of the black background layer is 50%.

17. The display method as claimed in claim 1, wherein the scroll-in effect is represented by radiative rays with a clockwise or counterclockwise direction and the scroll-out effect is represented by radiative rays with a direction opposite to that of the scroll-in effect.

18. The display interface as claimed in claim 9, wherein the scroll-in effect is represented by radiative rays with a clockwise or counterclockwise direction and the scroll-out effect is represented by radiative rays with a direction opposite to that of scroll-in effect.

* * * * *